United States Patent [19]

Wingo, Jr.

[11] Patent Number: 4,985,931

[45] Date of Patent: Jan. 22, 1991

[54] SHOCK ABSORBING PAD STRUCTURE FOR ATHLETIC EQUIPMENT

[75] Inventor: James C. Wingo, Jr., Houston, Tex.

[73] Assignee: Riddell, Inc., Chicago, Ill.

[21] Appl. No.: 424,069

[22] Filed: Oct. 17, 1989

[51] Int. Cl.[5] ..... A41D 13/00

[52] U.S. Cl. ..... 2/2; 2/268

[58] Field of Search ..... 2/2, 267, 268, 414, 2/45, 44

[56] References Cited

U.S. PATENT DOCUMENTS

| | | | |
|---|---|---|---|
| 3,197,357 | 7/1965 | Schulpen | 161/116 |
| 4,213,202 | 7/1980 | Larry | 2/2 |
| 4,276,666 | 7/1981 | Yamada | 5/481 |
| 4,370,754 | 2/1983 | Donzo | 2/2 |
| 4,486,901 | 12/1984 | Donzis | 2/2 |
| 4,513,449 | 4/1985 | Donzis | 2/2 |
| 4,554,681 | 11/1985 | Kirkland | 2/2 |
| 4,610,034 | 9/1986 | Johnson | 2/2 |
| 4,675,912 | 6/1987 | Kirkland | 2/2 |
| 4,700,403 | 10/1987 | Vacanti | 2/2 |
| 4,739,522 | 4/1988 | Lassiter et al. | 2/69 |
| 4,926,503 | 5/1990 | Wingo, Jr. | 2/2 |

OTHER PUBLICATIONS

Cover Sheet and Two Pages of Sep. 1989 Catalog #2 of Cassemco, Inc.

*Primary Examiner*—William A. Cuchlinski, Jr.
*Assistant Examiner*—W. Morris Worth
*Attorney, Agent, or Firm*—Ben D. Tobor

[57] ABSTRACT

A shock absorbing pad structure for athletic equipment, such as shoulder pads, has a foam member, having an undulated configuration formed by a plurality of elevations and dperessions, arranged in a staggered relationship with respect to one another, disposed within a flexible, substantially air impermeable enclosure. The flexible enclosure has at least one air permeable portion disposed therein.

30 Claims, 2 Drawing Sheets

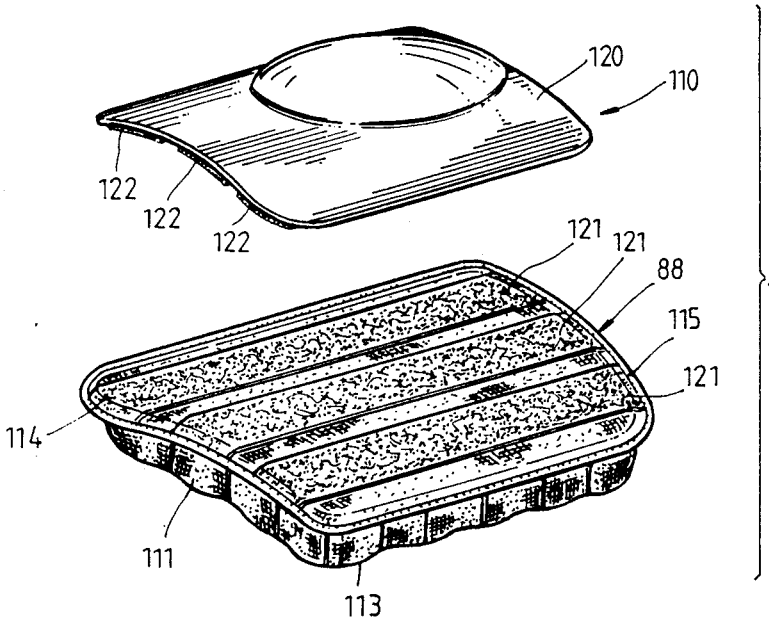
FIG.4
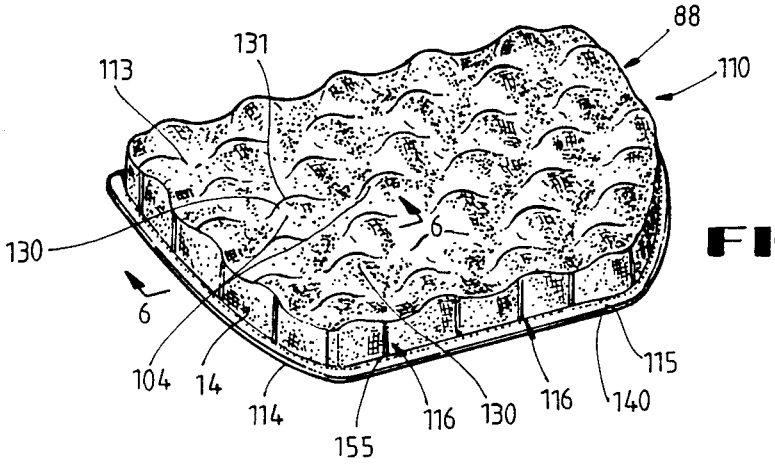
FIG.5
FIG.6
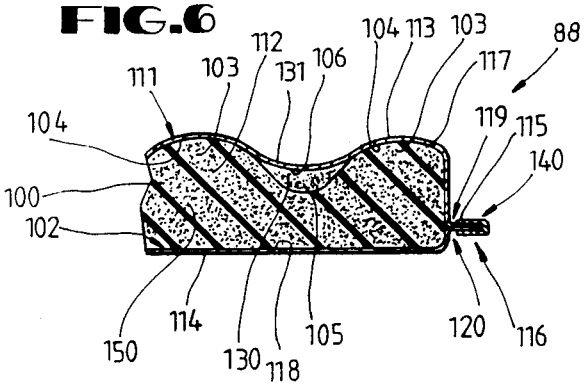
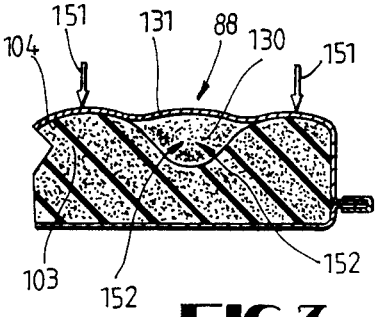
FIG.7

SHOCK ABSORBING PAD STRUCTURE FOR ATHLETIC EQUIPMENT

1. FIELD OF THE INVENTION

The invention relates to a shock absorbing pad structure for athletic equipment, such as football shoulder pads, and other types of athletic shock absorbing pads.

2. DISCUSSION OF THE PRIOR ART

Athletic equipment, such as helmets, shoulder pads, rib protectors, hip pads, thigh pads, and other types of pads, are commonly worn by participants in a great variety of sports in which body contact with either another participant or with a piece of equipment, used in the sport, presents the risk of injury. Such equipment has long been known and used by athletes in contact sports, such as football, hockey and baseball.

Typically, prior art athletic equipment includes an outer protective plate member, typically made of a suitable rigid plastic material, the protective plate member overlying a layer of soft padding material The protective plate member receives the applied impact force, and serves to spread the impact force over a large area where it is absorbed and cushioned by the soft padding material. Prior art padding materials include: cotton padding, foam rubber, open cell foam material, closed-cell foam material, sponge rubber, expanded rubber. The resilience of the padding material is intended to absorb a portion of the applied force Another structure used for padding material for such athletic equipment includes a variable pressure pad which includes two superimposed plies of a lightweight, non elastic fluid impervious fabric material which is sealed to form a pressure tight inflatable garment which does not distend, such as is disclosed in U.S. Pat. No. 4,370,754, issued Feb. 1, 1983, to Byron A. Donzis. Another type of padding material includes a flexible enclosure containing a multi-layered laminant of at least three open-cell foams of different foam density, the interior of the fabric structure being in fluid communication with the atmosphere outside the shock absorbing structure. This type of padding material or shock absorbing pad structure, is disclosed in U.S. Pat. No. 4,486,901, issued Dec. 11, 1984, to Byron A. Donzis.

All of the foregoing shock absorbing pad structures suffer from at least some of the following disadvantages. Many of the prior art shock absorbing pad structures are not hygenic, since the padding absorbs perspiration and cannot be washed regularly. Many of the pneumatic shock absorbing pad structures have sealed air chambers which merely transfer the shock and impact forces to the body, rather than helping to dissipate such impact forces. Some pneumatic type shock absorbing pads utilize various types of valves to provide fluid flow between various chambers; however, the valves increase the cost and complexity of the manufacturing process of the padding, as well as involve the possibility of a portion of the person wearing the body contacting the valves. Other types of padding suffer the disadvantages of either ballooning out of shape, bottoming out, or loss of resiliency due to repeated impact forces, whereby the efficacy of the padding is greatly decreased. Still other prior art pads suffer the disadvantages of decreased durability and are expensive and inefficient to manufacture.

Accordingly, prior to the development of the present invention, there has been no shock absorbing pad structure for athletic equipment which: is relatively hygenic; dissipates and minimizes the impact forces imparted to the wearer of the pad structure; does not require mechanical valving which can increase the cost and complexity of the manufacturing process; is not subject to ballooning, bottoming out, or a loss of resiliency; and is durable, inexpensive and efficient to manufacture. Therefore, the art has sought a shock absorbing pad structure for athletic equipment which: is relatively hygenic; better dissipates and reduces the impact forces imparted to the player wearing the shock absorbing pad structure; does not not include mechanical valving; is not subject to ballooning, bottoming out, or excessive loss of resiliency; and is durable, inexpensive and efficient to manufacture.

SUMMARY OF THE INVENTION

In accordance with the invention, the foregoing advantages have been achieved through the present shock absorbing pad structure for athletic equipment. The present invention includes: a flexible enclosure having first and second faces and a periphery defining a cavity, the first and second faces and periphery being substantially air impermeable and the enclosure having at least one air permeable portion; and a flexible foam member disposed within the cavity, the foam member having at least one surface disposed adjacent one of the faces of the enclosure, the at least one surface of the foam member having an undulated configuration formed by a plurality of elevations and depressions arranged in an alternating, staggered relationship with respect to one another. A further feature of the present invention is that the plurality of elevations and depressions may be interconnected by a plurality of ridge connector portions, and the foam member may be open cell foam.

An additional feature of the present invention is that the elevations may each have a top portion, and substantially all of the top portions of the elevations may contact the adjacent face of the enclosure. Another feature of the present invention is that substantially all of the top portions of the elevations may be fixedly secured to the adjacent face of the enclosure.

A further feature of the invention is that the plurality of elevations and depressions may be interconnected by a plurality of ridge connector portions, substantially all of the ridge connector portions may be fixedly secured to the adjacent face of the enclosure, and a plurality of air chambers are formed, each air chamber being bounded by a depression, adjacent elevations and ridge portions, and a portion of the adjacent face of the enclosure which overlies the depression. Another feature of the invention is that the top portions of the elevations and the ridge connector portions may be fixedly secured to the adjacent face of the enclosure by heat sealing the adjacent face thereto.

In accordance with the invention, the foregoing advantages have also been achieved through another aspect of the present invention which is a method for making a shock absorbing pad structure for athletic equipment. This aspect of the present invention includes the steps of: forming a flexible enclosure having a cavity defined by first and second faces and a periphery, the first and second faces and periphery being substantially air impermeable; disposing a flexible foam member, with at least one surface of the foam member, having an undulated configuration formed by a plurality of elevations and depressions arranged in an alternating, staggered relationship with one another with a plurality of elevations and depressions interconnected by a plurality of ridge connector portions, within the flexible enclosure with the plurality of elevations disclosed adjacent a face of the flexible enclosure: and sealing the first and second faces about the periphery while providing at least one air permeable portion in the enclosure. Another feature of the present invention is the step of utilizing an open-cell foam for the foam member.

An additional feature of the present invention includes the step of disposing the foam member within the flexible enclosure with substantially all the elevations contacting the adjacent face. Another feature of the present invention includes the step of fixedly securing a top portion of each elevation to the adjacent face. Another feature of the present invention includes the steps of fixedly securing substantially all of the ridge connector portions to the adjacent face, and forming a plurality of air chambers within the flexible enclosure, each air chamber being bounded by a depression, adjacent elevations and ridge connector portions, and a portion of the adjacent face of the enclosure which overlies the depression.

An additional feature of the present invention includes the step of fixedly securing the top portions and ridge connector portions t the adjacent face by heat sealing the adjacent face thereto.

In accordance with another aspect of the present invention, the foregoing advantages have been also achieved through a shock absorbing pad structure for athletic equipment which includes: a flexible enclosure, having first and second faces and a periphery, defining a cavity, the first and second faces and periphery being substantially air impermeable and the enclosure having at least one air permeable portion; a plurality of air chambers disposed within the flexible enclosure; a plurality of compressible reservoirs, for releaseably holding a quantity of air, disposed within the flexible enclosure: and the air chambers and compressible reservoirs are disposed within the flexible enclosure in an alternating, staggered relationship with each other, the air chambers and compressible reservoirs being in fluid communication with each other and with the at least one air permeable portion of the flexible enclosure.

Another feature of the present invention is that the plurality of compressible reservoirs may be a plurality of elevations formed on a flexible foam member having an undulated configuration formed by the plurality of elevations and a plurality of depressions arranged on at least one surface of the foam member in an alternating, staggered relationship with respect to one another.

A further feature of the present invention is that the depressions and elevations may be interconnected by a plurality of ridge connector portions, and the air chambers may be bounded by a depression, adjacent elevations and ridge connector portions, and a portion of a face of the flexible enclosure which overlies the depression. An additional feature of the present invention is that the elevations may have top portions. and the top portions and ridge connector portions may be heat sealed to a face of the flexible enclosure.

The shock absorbing pad structure for athletic equipment of the present invention, when compared with previously proposed shock absorbing pad structures, has the advantages of: being relatively hygenic; helping to dissipate and reduce impact forces incurred; not including a mechanical valve device; not being subject to ballooning, bottoming out, or excessive loss of resiliency; and being durable, inexpensive and efficient to manufacture and use.

It should be noted that due to the nature of the sport of football, as well as other contact sports, no protective equipment or shock absorbing pad structures, such as shoulder pads, can prevent injuries; however, it is believed that such equipment can be designed to attempt to better protect the player from injuries.

BRIEF DESCRIPTION OF THE DRAWINGS:

In the drawings:

FIG. 4 is an exploded view of a shock absorbing pad structure in accordance with the present invention;

FIG. 5 is a perspective view of the shock absorbing pad structure of FIG. 4, after it has been rotated 180°;

FIG. 6 is a partial cross-sectional view taken along line 6—6 of FIG. 5; and FIG. 7 is a partial cross sectional view similar to that of FIG. 6, after an impact force has been sustained by the shock absorbing pad structure.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

Figure 1:
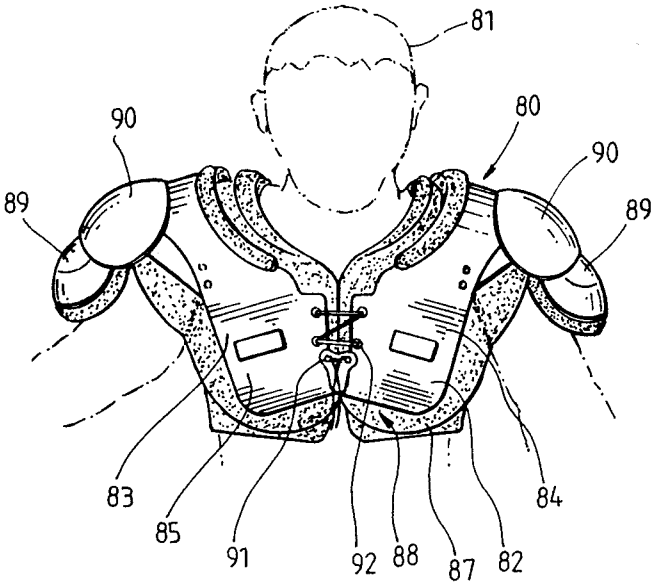
FIG. 1 is a front view of a football shoulder pad for use with a shock absorbing pad structure in accordance with the present invention.

In FIG. 1, a shoulder pad 80 for a football player 81 (shown in dotted lines) is shown to generally comprise left and right body arch members 82, 83, each body arch member including depending chest portions 84, 85 and depending back portions (not shown), the shoulder pad being bilaterally symmetrical. Shoulder pad 80 also includes a pad body 87, or shock absorbing pad structure 88, disposed beneath the body arch members 82, 83, which pad body 87 is either fixedly secured, or releaseably secured, to the body arch members 82, 83. The shoulder pad 80 may also be provided with conventional shoulder cups 89 which overlie the deltoid muscles of the football player 81, as well as conventional epaulets 90 may be attached to the body arch members 82, 83. As is well known in the art, depending back portions of body arch members may be permanently hinged together on a vertical axis over the football player's 81 back or spine, while the depending chest portions 84, 85 are connected together on a vertical line over the football player's sternum as by a lacing 91 passing through lace openings 92 provided on the depending chest portions 84, 85 of body arch members 82, 83. Body arch members 82, 83 as well as shoulder cups 89 and epaulets 90 are made of any suitable material such as a suitable plastic having the requisite strength and rigidity requirements to withstand the forces of impact incurred in the sport of football, as is well known in the art. In this regard, it should be noted that although the present invention is being described in connection with a football shoulder pad 80, the present shock absorbing pad structure 88 of the present invention could likewise be used in protective pads of similar construction which are worn by athletes for other contact sports, such as hockey. Furthermore, as will be hereinafter described in greater detail, the shock absorbing pad structure 88 could be used not only for a football shoulder pad body 87, but also for rib protector pads, thigh pads, elbow pads, knee pads and as a shock absorbing pad structure for use in football helmets, as well as other similar protective helmets, such as motorcycle and bicycling helmets.

Still with reference to FIG. 1, football shoulder pad 81, as well as other types of protective equipment operate in the following manner. An impact force is initially inflicted and sustained by the body arch members 82, 83, or other rigid plastic part of shoulder pad 81 and the rigid plastic part serves to distribute and dissipate the impact force inflicted upon the shoulder pad 81 over the surface area of the pad body 87, or shock absorbing pad structure 88, disposed beneath the rigid plastic member, such as body arch members 82, 83. Inasmuch as most of the plastic protective members, such as body arch members 82, 83, shoulder cups 89, and epaulets 90, as will as protective plate members utilized for thigh pads and other protective equipment for the human body, are of fairly standard construction and design, the effectiveness of such equipment is in major part dependent upon the design of the pad body 87, or shock absorbing pad structure 88, which underlies the rigid protective plate members, such as body arch members 82, 83, etc.

Figure 2:
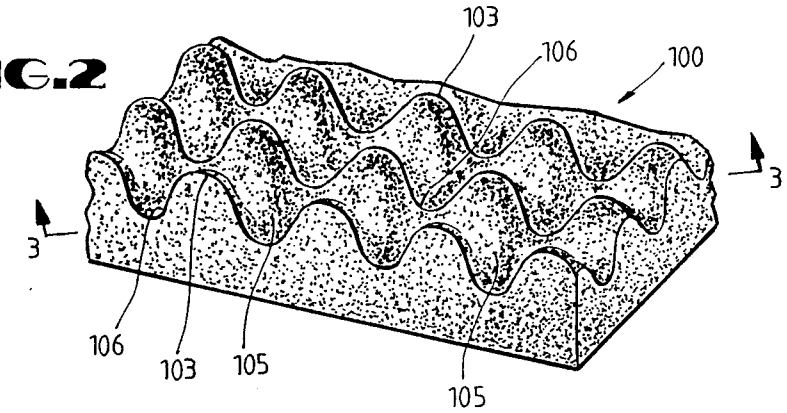
FIG. 2 is a perspective view of a portion of a flexible foam member for use with the shock absorbing pad structure in accordance with the present invention.
Figure 3:
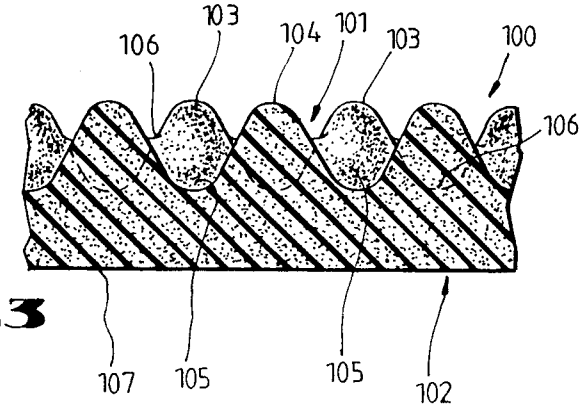
FIG. 3 is a partial cross sectional view taken along line 3—3 of FIG. 2.

With reference now to FIGS. 2 and 3, a flexible foam member 100 for use in a shock absorbing pad structure 88 in accordance with the present invention is shown. Flexible foam member 100 has upper and lower surfaces 101. 102, at least one of the surfaces, such as upper surface 101, having an undulated configuration formed by a plurality of elevations, or generally conical shaped protuberances 103, having a rounded apex 104, and a plurality of depressions 105, the plurality of elevations 103 and depressions 105 arranged in an alternating, staggered relationship with respect to one another. The plurality of elevations and depressions 103, 105 are preferably interconnected by a plurality of ridge connector portions 106. The other surface or lower surface 102, of flexible foam member 100 is preferably a relatively flat, planar surface 107, as seen in FIG. 3; however, lower surface 102 could have the same undulated configuration as upper surface 101, or other configurations. Flexible foam member 100 may be either an open, or closed cell foam material; however, as will be hereinafter described in greater detail, it is preferable that foam member 100 be an open-cell foam material, such as a polyolefin foam, such as polyurethane foam.

In order to function effectively in the shock absorbing pad structure 88 of the present invention, foam member 100 must have t he requisite physical characteristics to permit it to function properly within shock absorbing pad structure 88. In general, foam member 100 must have the requisite durability and resilience to function effectively as a part of the shock absorbing pad structure 88 of the present invention, as will be hereinafter described in greater detail. The durability of foam member 100 is in general a function of the density of the foam material used in the manufacture of foam member 100. Preferably, the density of the foam material used in foam member 100 falls within the range of from 1.5–4.0 pounds per cubic foot. A density of 2.8 plus or minus .1 pounds per cubic foot being a preferred value for the density of the foam material of foam member 100. One measurement of the resiliency of the foam material used in foam member 100 is the internal force displacement value of the foam material. This value is typically determined by compressing a 4 inch high block of the foam material 25% of its height, or 1 inch, and measuring the force required to achieve such compressor. Preferably, the internal force displacement of the foam material used in flexible foam member 100 falls within a range of from 30 to 80 pounds per 50 square inches, and the internal force displacement is preferably 50 plus or minus 5 pounds per 50 square inches. The dimension of the foam member 100 will of course be dependent, to some extent, upon what type of athletic equipment shock absorbing pad structure 88 is being utilized for; however, as an example, in the case of football shoulder pads 80, the height of foam member 100 measured from the lower surface 102 to the apex 104 is, approximately, initially 1 and ½ inches high. Preferably, the distance measured from apex 104 to depression 105 is from ⅞ to 1 inch high and the distance from lower surface 102 to depression 105 is approximately ½ inch.

With reference now to FIGS. 4–6, the construction of a shock absorbing pad structure 88 in accordance with the present invention will be described in greater detail. For illustration purposes only, shock absorbing pad structure 88 is illustrated in FIGS. 4 and 5 as being used in the construction of a thigh pad 110 which are typically worn by football players. It should be readily understood that the shock absorbing pad structure 88 could be utilized for other athletic equipment, such as for pad body 87 of FIG. 1, as well as a shock absorbing pad structure to be disposed beneath shoulder cups 89, as well as for other athletic equipment, as previously described.

The shock absorbing pad structure 88 is made by first forming a flexible enclosure 111 having a cavity 112 defined by first and second faces 113, 114 and a periphery 115, the first and second faces 113, 114, and periphery 115 being substantially air impermeable. As will be hereinafter described in greater detail, flexible enclosure 111 has at least one air permeable portion 116 disposed therein, which is preferably disposed in periphery 115. Faces 113, 114, are preferably sheets of a flexible fabric, such as Nylon, having the requisite strength, durability, and hygenic characteristics so as to be utilized for the manufacture of shock absorbing pad structure 88 for athletic equipment. Preferably, the interior surfaces 117, 118 of faces 113, 114 are provided with a coating of any suitable material which renders faces 113, 114 substantially air impermeable. Preferably, a polyurethane coating is utilized to render the interior surfaces of faces 113, 114 substantially air impermeable, as well as capable of being heat sealed, as will be hereinafter described.

Periphery 115 may be formed of a separate sheet of flexible fabric as is used for faces 113, 114 or periphery may be formed by the outer edges of one of the faces 113, 114 which covers the outer edges of the foam member 100 which is disposed within cavity 112 as will be hereinafter described in greater detail Materials other than Nylon, such as polyester blends, rayon, nylon twills, and similar materials, may be utilized for faces 113, 114 and periphery 115, provided such materials have the requisite strength and durability characteristics necessary for use in a shock absorbing pad structure, as well as being preferably non-absorbent for hygenic purposes. Additionally, such material should be, or be capable of being rendered, substantially air impermeable.

Still with reference to FIGS. 4–6, flexible foam member 100, as previously described, is disposed within the cavity 112 of flexible enclosure 111 with the plurality of elevations 103 disposed adjacent face 113 of flexible enclosure 111, such as by being disposed adjacent, or contacting, interior surface 117 of face 113. Faces, or pieces of fabric, 113, 114, may then be sealed together to form periphery 115 as by folding the outer edges of face 113 over the edges of foam member 100 and then sealing faces 113, 114 together. Flexible foam member 100 is thus disposed within flexible enclosure, 111 which is substantially air impermeable except for at least one air permeable portion 116, which is preferably disposed in periphery 115.

Face 114, the interior surface 118 of which is in contact with the lower surface 102 of flexible foam member 100 may have a conventional rigid protective plate member 120 disposed upon at least a portion of face 114 of flexible enclosure 111, whereby a thigh pad 110 is formed. Rigid protective plate member 120 may be preferably disposed upon, and releaseably secured to, flexible enclosure 111, as by a plurality of adhesive strips 121, disposed upon the outer surface of face 114, which adhesive strips 121 mate with a plurality of mating adhesive strips 122 disposed upon the underside of rigid protective plate member 120. Preferably, adhesive strips 121, 122 are a hook and eye fabric material such as VELCRO® which securely fastens rigid protective plate member 120 to flexible enclosure 111; however, will permit the removal of rigid protective plate member 120 for the purposes of repairing the shock absorbing pad structure 88, or for cleaning the shock absorbing pad structure 88.

Still with reference to FIGS. 4–6, foam member 100, when disposed within the flexible enclosure 111 is disposed with substantially all the elevations 103 contacting the interior surface 117 of adjacent face 113. Preferably, the apex, or top portion, 104 of each elevation 103 is fixedly secured to the interior surface 117 of adjacent face 113. The apex 104 of the elevations 103, and the sealing of first and second faces 113, 114 about periphery 115 may be accomplished in any suitable manner, such as by the use of glue, epoxy or other suitable adhesive. Preferably, the desired sealing and securing is accomplished by the application of heat to the outside surfaces of faces 113, 114, which heat is transferred through the fabric of 113, 114, and then melts the polyurethane coating disposed on the interior surfaces 117, 118 of faces 113, 114, whereby faces 113, 114 are sealed along periphery 115 and the polyurethane coating seals and secures the apex 104 of each elevation 103 of foam member 100 to the interior surface 117 of face 113. Likewise, the lower surface 102 of foam member 100 may be secured to the interior surface 118 of face 114 by the application of heat to the outer surface of face 114.

These sealing steps may be accomplished by applying the heat to faces 113, 114 by use of an iron, or other heated pressing member, the iron (not shown) being first applied to the outer surface of the first face 113, then ironing the second face 114 of flexible enclosure 111, and finally ironing and applying heat to the edges 119, 120 of faces 113, 114 to seal them one against the other to form periphery 115 of flexible enclosure 111. With a light application of pressure and heat, only the apex 104 of elevations 103 will be fixedly secured to the interior surface 117 of face, or fabric, 113. Upon application of more pressure, the interior surface 117 of face 113 will not only be secured to the apex 104 of each elevation 103, but also the interior surface 117 of face 113 will be fixedly secured to substantially all the ridge connector portions 106 of foam member 100. The resulting structure is a plurality of air chambers 130 are formed within shock absorbing pad structure 88, each air chamber 130 being bounded by a depression 105, adjacent elevations 103, and adjacent ridge portions 106, and a portion 131 of face 113 which overlies the depression 105. Because of the alternating, staggered relationship of the elevations 103 and depressions 105 of foam member 100, air chambers 130 are likewise disposed within shock absorbing pad structure 88 in an alternating, staggered relationship with respect to the top portions, or apexes, 104 of elevations 103, as seen in FIG. 5.

Still with reference to FIGS. 4–6, the formation of at least one air permeable portion 116 in enclosure 111 will be described As will hereinafter be described in greater detail, the shock absorbing pad structure of the present invention requires that the cavity 112 within flexible enclosure 111 be in fluid communication with ambient air disposed outside flexible enclosure 111 through the at least one air permeable portion 116, which is preferably disposed in periphery 115. The at least one air permeable portion can be provided in any suitable manner, such as by forming one or more openings in faces 113, 114 or periphery 115 which are in fluid communication with the interior cavity 112 of flexible enclosure 111. Preferably, when shock absorbing pad structure 88 is manufactured in the manner previously described, when the periphery 115 is sealed by a heat sealing step, the at least one air permeable portion 116 may be provided by folding a portion of a face 113, 114 over itself at the periphery 115 thereof, whereby at least one relatively narrow, air passageway 135 is formed and is disposed between the cavity 112 within the flexible enclosure 111 to outside the periphery 115 of flexible enclosure 111. Because of the folding over of the fabric of face 113, 114, the air passageway 135 is disposed in periphery 115. When the periphery 115 is ironed to seal periphery 115, the folded over portion of face 113, 114 is not completely sealed, whereby the air passageway 135 remains in fluid communication between the cavity 112 and outside periphery 115. Additionally, if desired, a conventional fabric binding tape 140 may be sewn about periphery 115, and the sewing step may provide openings to the folded portions of face 113, or 114, which form air passageways 135.

With reference to FIGS. 6 and 7, the operation of shock absorbing pad structure 88 will be described. FIG. 6 illustrates a portion of shock absorbing pad structure 88 before any impact force has been sustained by shock absorbing pad structure 88. In this configuration, each elevation 103 functions as a compressible reservoir 150 which releasably holds a quantity of air, and air chamber 130 likewise contains a quantity of air disposed therein. The portions 131 of face 113 overlying depressions 105 are in a "relaxed" configuration, whereby they are disposed over depressions 105 in a relatively unstressed manner. The compressible reservoirs 150 and air chambers 130, like elevations 103 and depressions 105, are disposed within the flexible enclosure 111 in an alternating, staggered relationship, with each other, the air chambers 130 and compressible reservoirs 150 being in fluid communication with each other and with the at least one air permeable portion 116 of the flexible enclosure 111.

Upon an impact force in the direction of arrows 151 of FIG. 7 being applied to face 113 of shock absorbing pad structure 188, elevations 103, or compressible reservoirs 150, are compressed and the air contained within compressible reservoirs 150 travels through foam member 100 in the following manner. Some of the air contained within each compressible reservoir 150 travels through the foam member 100 until it escapes through the at least one air permeable portion 116 of flexible enclosure 111. The escape of the air through air permeable portion 116 is restricted, because of the limited number of, and restricted size of the air passageways 135, forming the at least one air permeable portion. Thus, not all of the air contained within compressible reservoirs 150, or flexible enclosure 111, can be released instantaneously, upon an application of a force in the direction of arrows 151. The air contained within compressible reservoirs 150 and flexible enclosure 111 thus reacts against the impact force, whereby it absorbs some of the energy from the impact force, and serves to cushion the impact force by spreading the force over the surface area of the shock absorbing pad structure 88, and by permitting the controlled release of the air within compressible reservoirs 150 and flexible enclosure 111 in a restricted manner through the at least one air permeable portion 116 of flexible enclosure 111.

At the same time that the air held in compressible reservoirs 150, or elevations 103, is moving through foam member 100 toward the air permeable portion 116 of flexible enclosure 111, some of that air is passing through foam member 100 into air chambers 130, in the direction shown by arrows 152. Because air chambers 130 already contain a certain amount of air, the additional air flowing therein, causes the portions 131 of face 113 overlying depressions 105 to billow, or flex outwardly, in order to accommodate the additional quantity of air contained within air chambers 130. As seen in FIG. 7, the portions 131 of face 113 assume a more stressed configuration, wherein the portions 131 of face 113 assumes an expanded configuration. As the apexes 104 of elevations 103 are compressed by the impact forces in the direction of arrows 151, apexes 104 move downwardly, whereas portions 131 of face 113 moves upwardly as previously described due to the air being forced into air chambers 130. The movement of the air into air chambers 130 and the expansion of air chamber 130, including the upward movement of portions 131 of face 113, also serve to resist the impact forces and absorb and cushion against the impact force. The combination of the compression of compressible reservoirs 150 and the expansion of air chambers 130, with the simultaneous, controlled release of air through the at least one air permeable portion 116 of flexible enclosure 111, serves to provide an enhanced shock absorbing pad structure 188.

After the termination of the impact force in the direction of arrows 151, the resilient foam member 100, including elevations 103, or compressible reservoirs 150, expand back into t heir initial, uncompressed configuration, and the apexes 104 of the elevations 103, move outwardly against flexible enclosure 111. As elevations 103 expand from their compressed configuration of FIG. 7, such movement of faces 113, 114 is analogous to a bellows action, wherein air is drawn into flexible enclosure 111 through the at least one air permeable portion 116. Air then is drawn into the compressible reservoirs 150, as well as air chambers 130, and shock absorbing pad structure 188 assumes the configuration shown in FIG. 6, until such time as another impact force is sustained by shock absorbing pad structure 88.

It is to be understood that the invention is not limited to the exact details of construction, operation, exact materials or embodiment shown and described, as obvious modifications and equivalents will be apparent to one skilled in the art; for example, other configurations of foam could be utilized, such as hexagonal shaped elevations. Accordingly, the invention is therefore to be limited only by the scope of the appended claims.

I claim:

1. A shock absorbing pad structure for athletic equipment comprising:

a flexible enclosure, having first and second faces and a periphery, defining a cavity, the first and second faces and periphery being substantially air impermeable and the enclosure having at least one air permeable portion; and a flexible foam member disposed within the cavity, the foam member having at least one surface disposed adjacent one of the faces of the enclosure, the at least one surface of the foam member having an undulated configuration formed by a plurality of elevations and depressions arranged in an alternating, staggered relationship with respect to one another.

2. The shock absorbing pad structure of claim 1, wherein the plurality of elevations and depressions are interconnected by a plurality of ridge connector portions.

3. The shock absorbing pad structure of claim 1, wherein the foam member is open-cell foam.

4. The shock absorbing pad structure of claim 3, wherein the open-cell foam has a density in a range from 1.5–4.0 pounds per cubic foot.

5. The shock absorbing pad structure of claim 3, wherein the open-cell foam has an internal force displacement in a range from 30–80 pounds per 50 square inches.

6. The shock absorbing pad structure of claim 1, wherein the elevations each have a top portion, and substantially all of the top portions of the elevations contact the adjacent face of the enclosure.

7. The shock absorbing pad structure of claim 6, wherein substantially all of the top portions of the elevations are fixedly, secured to the adjacent face of the enclosure.

8. The shock absorbing pad structure of claim 7, wherein the plurality of elevations and depressions are interconnected by a plurality of ridge connector portions, substantially all of the ridge connector portions are fixedly secured to the adjacent face of the enclosure, and a plurality of air chambers are formed, each air chamber being bounded by a depression, adjacent elevations and ridge connector portions, and a portion of the adjacent face of the enclosure which overlies the depression.

9. The shock absorbing pad structure of claim 7, wherein the top portions of the elevations and the ridge connector portions are fixedly secured to the adjacent face of the enclosure by heat sealing the adjacent face thereto.

10. The shock absorbing pad structure of claim 1, including a rigid protective plate member disposed upon at least a portion of one of the faces of the enclosure.

11. The shock absorbing pad structure of claim 10, wherein the foam member surface having an undulated configuration is disposed adjacent the first face of the enclosure and the rigid protective plate member is disposed upon the second face of the enclosure.

12. The shock absorbing pad structure of claim 1, wherein the at least one air permeable portion is disposed in the periphery.

13. The shock absorbing pad structure of claim 12, wherein the at least one air impermeable portion is at least one air passageway formed in the periphery.

14. A method for making a shock absorbing pad structure for athletic equipment comprising the steps of forming a flexible enclosure having a cavity defined by first and second faces and a periphery, the first and second faces and periphery being substantially air impermeable;

disposing a flexible foam member, with at least one surface of the foam member having an undulated configuration formed by a plurality of elevations and depressions arranged in an alternating, staggered relationship with one another with the plurality of elevations and depressions interconnected by a plurality of ridge connector portions, within the flexible enclosure with the plurality of elevations disposed adjacent a face of the flexible enclosure; and sealing the first and second faces about the periphery, while providing at least one air permeable portion in the enclosure.

15. The method of claim 14, including the step of utilizing an open-cell foam for the foam member.

16. The method of claim 15, including the step of utilizing an open-cell foam having a density in the range of from 1.5–4.0 pounds per cubic foot.

17. The method of claim 15, including the step of utilizing an open-cell foam having an internal force displacement in the range of from 30–80 pounds per 50 square inches.

18. The method claim 14, including the step of disposing the foam member within the flexible enclosure with substantially all the elevations contacting the adjacent face.

19. The method of claim 18, including the step of fixedly securing a top portion of each elevation to the adjacent face.

20. The method of claim 19, including the steps of fixedly securing substantially all of the ridge connector portions to the adjacent face, and forming a plurality of air chambers within the flexible enclosure, each air chamber being bounded by a depression, adjacent elevations and ridge portions, and a portion of the adjacent face of tho enclosure which overlies the depression.

21. The method of claim 19, including the step of fixedly securing the top portions and ridge connector portions to the adjacent face by heat sealing the adjacent face thereto.

22. The method of claim 14, wherein the air permeable portion in the enclosure is provided by folding a portion a face over itself at the periphery, thereof to provide an air passageway from the cavity within the flexible enclosure to outside the periphery.

23. The method of claim 14, including the step of disposing a rigid protective plate member upon at least a portion of one of the faces of the flexible enclosure.

24. The method of claim 23, wherein the foam member surface having an undulated configuration is disposed adjacent the first face of the enclosure, and the rigid protective plate member is disposed upon the second face of the flexible enclosure.

25. A shock absorbing pad structure for athletic equipment comprising:

a flexible enclosure, having first and second faces and a periphery, defining a cavity, the first and second faces and periphery being substantially air impermeable and the enclosure having at least one air permeable portion;

a plurality of air chambers disposed within the flexible enclosure;

a plurality of compressible reservoirs, for releasably holding a quantity of air, disposed within the flexible enclosure; and the air chambers and compressible reservoirs are disposed within the flexible enclosure in an alternating, staggered relationship with each other, the air chambers and compressible reservoirs being in fluid communication with each other and with the at least one air permeable portion of the flexible enclosure.

26. The shock absorbing pad structure of claim 25, wherein the plurality of compressible reservoirs are a plurality of elevations formed on a flexible foam member having an undulated configuration formed by the plurality of elevations and a plurality of depressions arranged on at least one surface of the foam member in an alternating, staggered relationship with respect to one another.

27. The shock absorbing pad structure of claim 26, wherein the depressions and elevations are interconnected by a plurality of ridge connector portions, and the air chambers are bounded by a depression, adjacent elevation and ridge portions, and a portion of a face of the flexible enclosure which overlies the depression.

28. The shock absorbing pad structure of claim 27, wherein the elevations have top portions, and the top portions and the ridge connector portions are heat sealed to a face of the flexible enclosure.

29. The shock absorbing pad structure of claim 25, wherein the at least one air permeable portion is disposed in the periphery.

30. The shock absorbing pad structure of claim 29, wherein the at least one air permeable portion has at least one air passageway formed in the periphery.

* * * * *

UNITED STATES PATENT AND TRADEMARK OFFICE

CERTIFICATE OF CORRECTION

PATENT NO. : 4,985,931

DATED : January 22, 1991

INVENTOR(S) : James C. Wingo, Jr.

It is certified that error appears in the above-identified patent and that said Letters Patent is hereby corrected as shown below:

On the references cited section on the title page the U.S. Patent No. 4,370,754 delete "Donzo", and insert --Donzis--.

In Column 5, line 56, delete "t he", and insert --the--.

In Column 6, line 7, delete "compressor", and insert --compression--.

In Column 9, line 61, delete "t heir", and insert --their--.

In Column 10, line 48, after "fixedly", delete the (,).

Signed and Sealed this

Nineteenth Day of May, 1992

*Attest:*

DOUGLAS B. COMER

*Attesting Officer*

*Acting Commissioner of Patents and Trademarks*